United States Patent [19]

Howard et al.

[11] Patent Number: 4,531,311

[45] Date of Patent: Jul. 30, 1985

[54] DATA INFORMATION DISPLAY DEVICE

[75] Inventors: Fred Howard, New York; Sydney Edson, East Meadow; Milton J. Merl, New City, all of N.Y.; Silvio J. Di Marchi, Wyckoff, N.J.

[73] Assignee: Marlboro Marketing, Inc., New York, N.Y.

[21] Appl. No.: 507,244

[22] Filed: Jun. 23, 1983

[51] Int. Cl.[3] ..... G09F 3/18

[52] U.S. Cl. ..... 40/10 R; 40/16

[58] Field of Search ..... 40/10 R, 11 R, 16.2, 40/16.4, 5, 16; 248/226 A, 278

[56] References Cited

U.S. PATENT DOCUMENTS

| | | | |
|---|---|---|---|
| 1,033,915 | 7/1912 | McDonald | 402/68 |
| 1,343,569 | 6/1920 | Levy | 40/5 |
| 1,951,611 | 3/1934 | Hooge | 40/19.5 |
| 2,032,533 | 3/1936 | Garfinkle | 40/16.4 |
| 2,640,288 | 6/1953 | Orlin | 40/16.2 |
| 2,755,576 | 7/1956 | Golden | 40/10 R |
| 2,849,812 | 9/1958 | Zarges | 40/5 |
| 3,141,253 | 7/1964 | Bartram | 40/129 |
| 3,228,131 | 1/1966 | Heck | 40/11 R |
| 3,469,813 | 9/1969 | Rizzi | 248/475 |
| 3,645,485 | 2/1972 | Gold | 248/223 |
| 3,877,163 | 4/1975 | Bissonet | 40/16.4 |
| 3,889,408 | 6/1975 | Offner | 40/10 R |
| 3,899,841 | 8/1975 | Berger | 40/11 |
| 4,140,224 | 2/1979 | Celeste | 40/16.2 |
| 4,246,710 | 1/1981 | Mixer | 40/16.4 |
| 4,319,731 | 3/1982 | Pfeifer | 248/223.4 |
| 4,351,440 | 9/1982 | Thalenfeld | 211/57.1 |

FOREIGN PATENT DOCUMENTS

| | | | |
|---|---|---|---|
| 2220075 | 11/1973 | Fed. Rep. of Germany | 40/11 R |
| 344618 | 3/1960 | Switzerland | 40/16.4 |

OTHER PUBLICATIONS

"Fish ® Hook Front Information Safety Hooks" Data Sheet, Date and Author Unknown.

*Primary Examiner*—John J. Wilson

*Attorney, Agent, or Firm*—Wolder, Gross & Yavner

[57] ABSTRACT

In a data information display device for use with products displayed in a shelf environment. The unit includes a bracket which is designed to mount either adhesively to the front edge of a shelf or by adhesive or other gripping means to a typical ticket rail mounted on the front edge of a shelf. Depending from the bracket is a support member which rotatably carries a data-carrying member having two surfaces, the front surface carrying information for a consumer of the goods and the rear surface carrying information used by store personnel for reorder purposes. The unit normally hangs in a position with the consumer information visible. By simple rotation of the member of the data-carrying member the store reorder information becomes visible and, when utilized, the supporting force is removed and the data-carrying member resumes its normal position.

9 Claims, 16 Drawing Figures

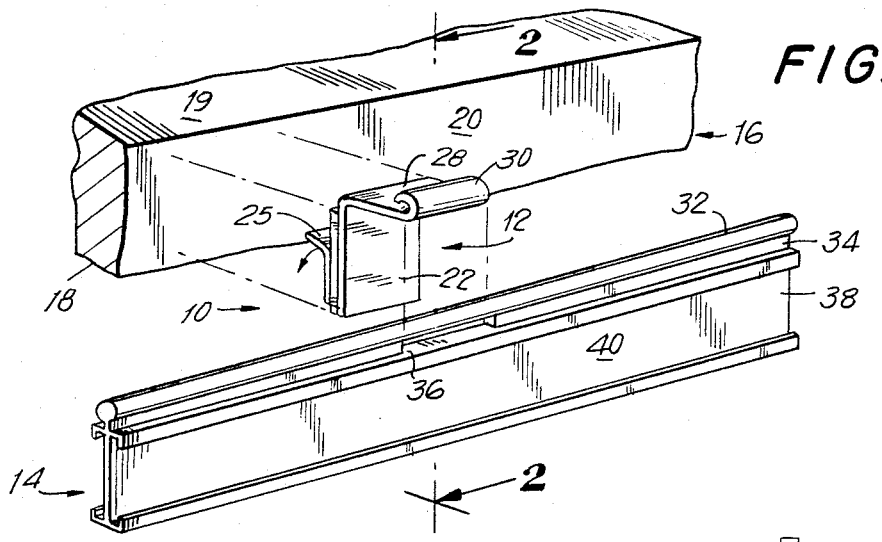
FIG. 1
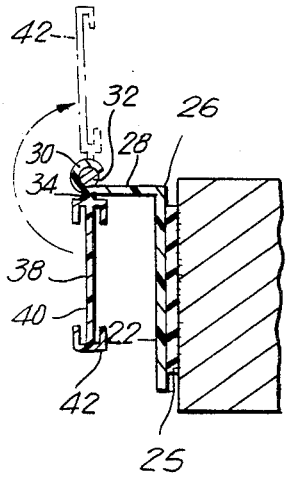
FIG. 2
FIG. 3
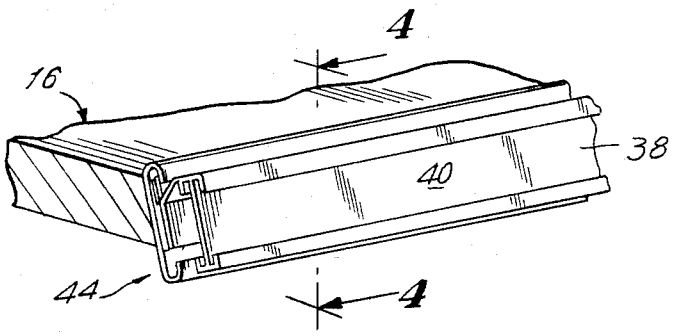
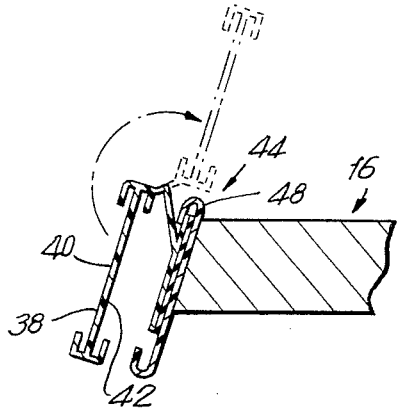
FIG. 4

DATA INFORMATION DISPLAY DEVICE

The present invention relates to a new and improved device for data information display in a store environment.

In particular, it relates to a device to be secured to a shelf edge or rail with items being placed upon the shelf, and the display device being secured to the front edge of the shelf, thus providing normal consumer purchasing information, and store reorder code information.

BACKGROUND OF THE INVENTION

The use of shelves to display merchandise is probably one of the most ancient forms of product display utilized by merchants. However, it is only in recent years that the merchant has become significantly aware that advanced methods of display and presentation of information results in significant increases in sales and productivity.

Under recently enacted consumer statutes, the purchasing public is given access to information regarding the product they buy. More specifically, information such as the unit price, the total price, the generic name of the product and the name of the manufacturer or trademark is usually made available to the consumer on the display. In the past this has been done by using the ticket rails normally secured to the front edge of shelves. It was also possible to place this information directly upon the front edge of a shelf should no rail be present.

One of the major problems in operation of a retail store is to know when shelf inventory is low, and restocking the required inventory in the appropriate location. In the past this has been accomplished by visual observation, making notes, going to warehouse inventory locations and taking the appropriate volume and placing it upon the shelves. In recent years, the Universal Product Code has come into great popularity, with each product having a different code.

It has become possible to simply scan the UPC Code in the front edge of shelves to articulate reorder needs, with reorder inventory delivered to the location. This greatly improves the productivity and efficiency of stocking depleted shelves.

Such information also must be visually available to the store personnel. It is possible to place the consumer information and reorder codes side by side on the front edge of shelves. However, this results in much scrambled information at each product location, and causes confusion in the minds of the consumer, who cannot digest it.

It is therefore an object of the present invention to provide a new and improved consumer information/-reorder code display device which allows both consumer and store reorder information to be visible, as required.

Yet another object of the present invention is to provide a new and improved display device which visually discloses only consumer information under normal circumstances.

Still a further object of the present invention is to provide an invention of the character described in which simple rotation of a portion of the invention results in visual display of the information required by the store personnel for reorder purposes.

Still yet a further object of the present invention is to provide a display device which presents a pleasing and attractive appearance.

Still yet a further object of the present invention is to provide a display device of the character described which may be adaptable for mounting to the front edge of a shelf and which is therefore usuable with existing shelf structures.

Still yet another object of the present invention is to provide a display device which may be readily secured to any style, size, or configuration of ticket rail.

Still yet a further object of the present invention is to provide a display device of the character described which will be simple and inexpensive to manufacture and yet be durable to a high degree in use.

In accordance with the above and other objects, the display device of the present invention includes a bracket which is adapted to be secured to the front surface of a shelf or the front surface of a ticket rail secured to the front surface of a shelf. The bracket carries a support member extending therefrom. The support member is rigidly secured to the bracket and has means to rotably grip a data-carrying member having a front surface upon which is displayed consumer information and a rear surface upon which is displayed reorder information for the store personnel. The data-carrying member is hinged to the support member either by a interlocking bead and hook type hinge or by a living hinge, depending upon the materials used for fabrication of the invention. The data-carrying member has channels so that there can be a interchange of display information.

A greater understanding of the present invention will be afforded upon consideration of the following, detailed description of a preferred, but nonetheless illustrative embodiment of the present invention when taken in conjunction with the annexed drawings wherein:

FIG. 1 is a prospective, exploded view of the present invention showing the means of securing the bracket to the front edge of the store shelving and the normal position of the data-carrying member;

FIG. 2 is an enlarged, cross-sectional view taken along the lines 2—2 of FIG. 1;

FIG. 3 is a view similar to FIG. 1. of a modified embodiment of the present invention, showing a unit secure to a ticket rail in turn secured to the front edge of a shelf;

FIG. 4 is an enlarged, cross-sectional view, taken along the lines 4—4 of Fig. 2, showing the normal position of the data-carrying member, and showing in phantom the rotated position of the data-carrying member with visual access to the store reorder information.

Figure 5:
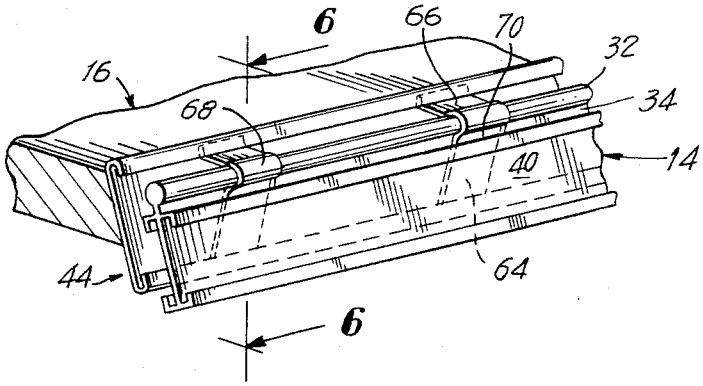
FIG. 5 is a view similar to Fig. 1 of another embodiment of the invention.

Referring to the figures and more particularly to FIGS. 1 and 2, there is generally shown a data information display device which broadly includes a bracket member 10, a support member 12, and a data-carrying member 14. The unit is designed to be secured to a shelf 16 normally attached to the standard gondola or a wall or some other means of horizontal support, such as might be found in a store. The shelf is defined by a lower surface 18, and an upper surface 19, and a front edge 20.

Turning to the bracket member 10 it is defined by a base member 22 carrying an adhesive layer 24 with the adhesion surface protected by a strip 25 in the well-known manner.

Depending via a right angle 26 from the bracket 10 is the support member 12. This member is defined by an arm 28 terminating in a hook portion 30. The hook portion is essentially circular in the cross-sectional configuration (see FIG. 2), and extends for a length in access of 180°. This is to insure that the data-carrying member will remain properly affixed.

The data-carrying member 14 includes an extended bead 32 extending upwardly from a neck 34 joined to a channel member 38. In a portion of the neck 34 there is defined a slot 36 which receives the hook portion 30. The channel member is bounded by a front surface, 40 and a rear surface 42.

As can best be seen in FIG. 2, when the adhesive protective member 25 is removed, the exposed adhesive tape layer can be adhered to the front edge 20 of the shelf, as best seen in FIG. 2. The unit hangs in the position shown and the front surface 40 is normally exposed. Upon this front surface may be placed the standard consumer information that is either required by law, or is provided by the merchant. When store personnel comes to the vacinity to check the status of merchandise and shelf inventory, this personnel simply rotates the data-carrying member 14 in a counterclockwise position as seen in FIG. 2, following the direction of the arrow until it assumes the position shown in phantom, with the rear surface 42 exposed. The rear surface may carry the Universal Price Code information or such other inventory information as is necessary to facilitate the responsibilities of the store personnel. When the inspection is completed, the force on the member 14 is removed and it rotates in a counterclockwise position under the influence of gravity to resume its normal position with consumer information exposed.

Turning to FIGS. 3 and 4 there is shown another embodiment of the invention in which like elements are given like numbers. However, this embodiment differs in that the front surface 20 of the shelf 14 is angled and carries a ticket rail 44. Ticket rails are fabricated in various sizes and dimensions, and the rear wall 46 may be straight or may be slightly curved and the surface itself may be flat or corrugated to enhance its design appearance. Generally, considering the lower and upper lips 47, 48, approximately $1\frac{1}{4}''$ are exposed to view. In discussing the remaining embodiments, all of which encompass utilization with ticket rails, the above mentioned variations in dimension and appearance have been taken in consideration. The major feature is that the width of the rail measured from the inside opposed surfaces of the lip 47,48 may vary widely, depending on the shelf construction.

Turning again to the embodiment shown in FIGS. 3 and 4, the display device is manufactured from extruded rigid vinyl with a interconnecting live hinge simultaneously extruded in a soft vinyl. The bracket member is essentially a Y-shaped extrusion with the base 50 having an adhesive layer 52 for securement against the wall 46 of the ticket rail. The width of the base is much less than the width of the ticket rail, it can be accommodated in varying widths and positioned where desired within the channel, if necessary. Extending upwardly from the base is the arm 54 of the support member secured to the living hinge 46 which in turned is secured to the data-carrying member. The difference between the first embodiment and this embodiment is that there is an additional channel formed in opposing rear surface 42 so that store inventory information may be removably inserted within the channels, whereas in the first embodiment it would have to be adhered to the rear surface.

Figure 6:
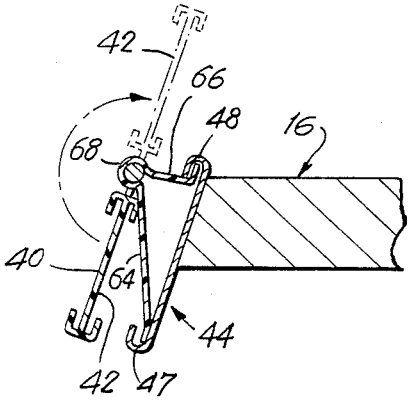
FIG. 6 is a cross-sectional view taken along the lines 6—6 of FIG. 5 and is similar to FIG. 4.

Turning to FIGS. 5 and 6 there is shown another embodiment of the present invention in which the bracket and support members are combined into a single element 60 having depending FIGS. 62 which are spring loaded into the channels formed by the lips 47,48 in the ticket rail. Extending from the lower finger is a long arm 64 and extending from the upper finger is a shorter arm 66 culminating in a hook shaped portion 68.

A data-carrying member 14 essentially the same as that disclosed in the embodiment shown in FIGS. 1 and 2 is carried with, however, a plurality of slots 70 positioned within the neck 34.

In operation, the fingers are worked through the slots so that the hook portion engages the bead 32 in the previously discussed manner and the fingers are depressed so that the unit may be placed within the channel and then the forces released to allow the fingers to expand and to be received within the channels formed by the lips. Thus, this can accommodate for a slight amount of variation in the widths of the channels. The data-carrying member may be extruded in plastic or aluminum and the clip may be plated, hardened spring steel. Generally, if there is significant variations in widths of the ticket rail, different size clips would be required. There is no necessity for adhesive.

Figure 7:
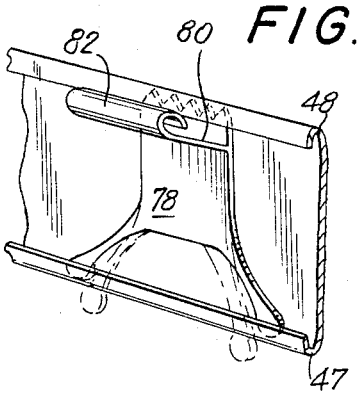
FIG. 7 is a front prospective view showing bracket means and a support member for yet another embodiment of the invention, with the legs of the member in phantom just prior to insertion in a ticket rail.
Figure 8:
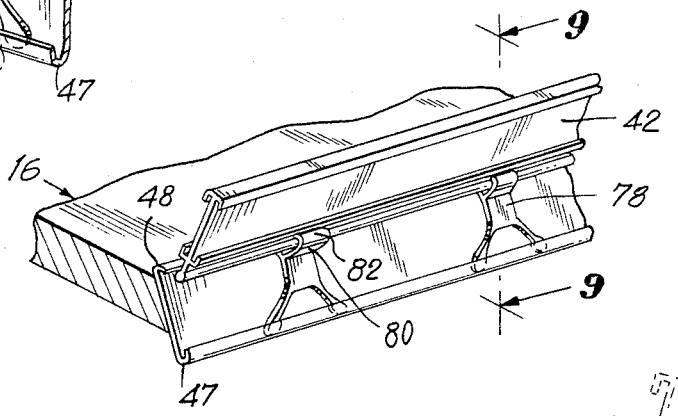
FIG. 8 is a view of another embodiment of the invention, similar to Fig. 3, but showing the data-carrying member in a partially rotated and raised position.
Figure 9:
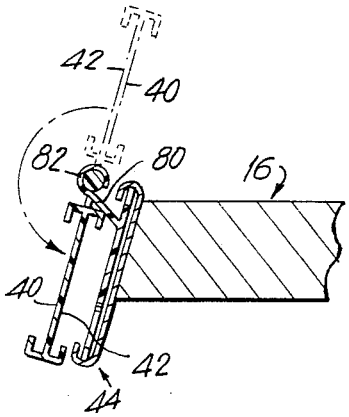
FIG. 9 is an enlarged, cross-sectional view taken along the lines 9—9 of FIG. 8.

Turning to the embodiment dislcosed in FIGS. 7-9, there is shown a spider clip 72 which acts as the bracket member. The spider clip has depending legs 74 which fit into the channel formed by the lower lip 47 and has an upper serrated edge to engage the upper lip 48. Depending upwardly and outwardly from the base 78 of the clip is the support member which includes an arm 80 and a hook portion 82. The spider clip may be formed as an injection molding with a certain amount of spring action in the legs to allow the adjustment shown from the normal outward position in phantom in FIG. 7 to the position secured in the ticket rails.

The data-carrying member may be the same as shown in the embodiment of FIGS. 5 and 6 and FIG. 8 shows a plurality clips engaging the slots 70.

Figure 10:
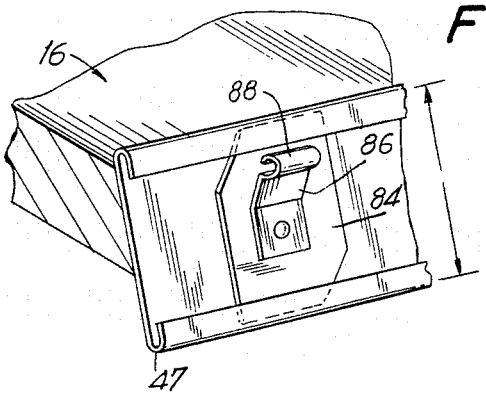
FIG. 10 is an enlarged view of yet another embodiment of the bracket means and support member, inserted into a ticket rail.
Figure 11:
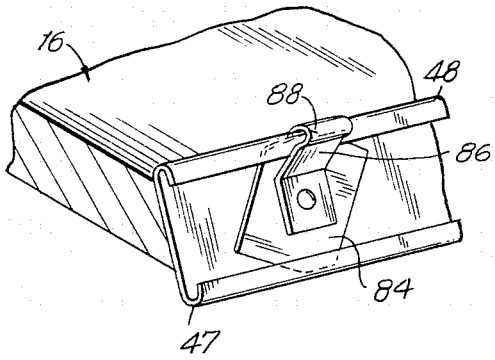
FIG. 11 shows the bracket means and support member of FIG. 10 with the bracket member rotated slightly to allow insertion in a ticket rail of a narrow width.
Figure 12:
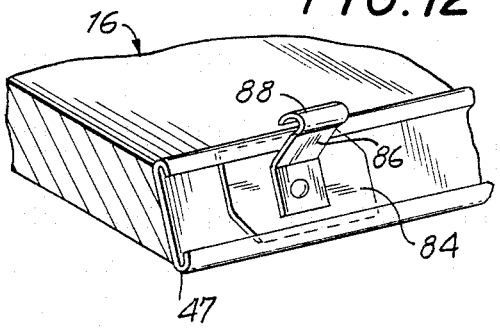
FIG. 12 is a view similar to FIGS. 10 and 11, but showing the bracket means inserted in a rail of even narrower width.
Figure 13:
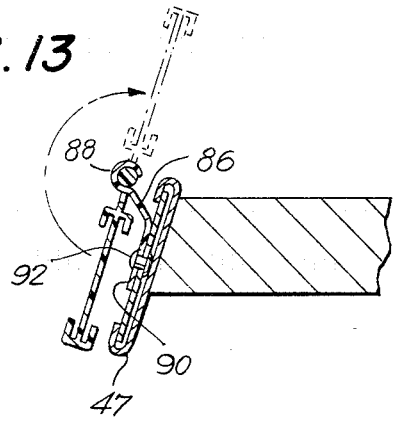
FIG. 13 is an enlarged, cross-sectional view taken along the lines 13—13 of FIG. 12.

Turning to the embodiment shown in FIGS. 10–13, there is seen a six sided plastic member having three pairs of parallel sides with the distance defined as being between 1", 1¼" and 1½", to accommodate ticket rails having this interior length between the opposed surfaces of the lips 47,48. The plastic member 84 is equivalent to the bracket and has a centrally positioned whole 86 located thereon secured to the member via the hole is the support member, in this case being an arm 88 having a corresponding hole 90 therein through which is position rivet 92 allowing rotational movement as seen in FIGS. 10, 11, and 12. The arm has a base portion 94 carrying the hole 90 and has an upwardly extending portion 86 terminating in a hook portion 88. The unit may carry any of the desired data-carrying members of either FIGS. 1 and 2 or FIGS. 3 and 4, for example and utilized in the normal fashion.

Figure 14:
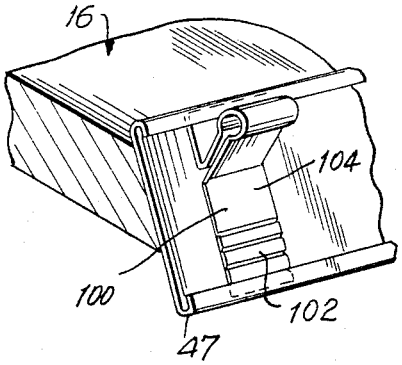
FIG. 14 is an enlarged partially cut away view of ticket rail showing yet another embodiment of the bracket means and support member.
Figure 15:
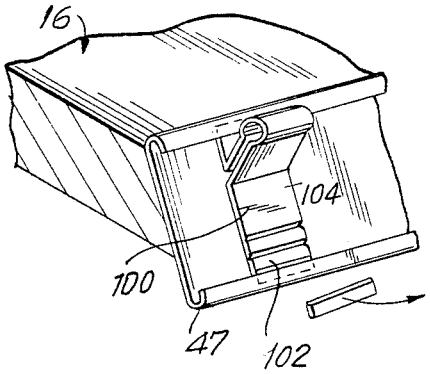
FIG. 15 is a view similar to FIG. 14, showing the removal of a portion of the bracket means to allow insertion in a ticket rail of narrower width.
Figure 16:
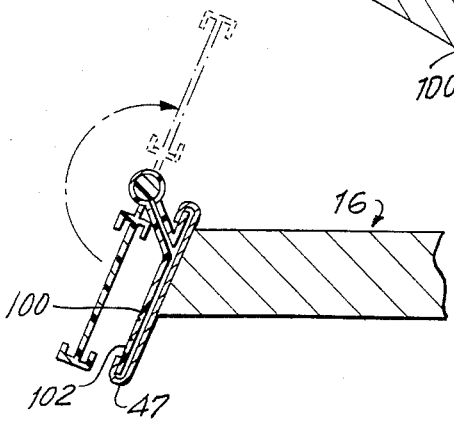
FIG. 16 is a view of the bracket means of FIGS. 14 and 15 in enlarged cross-section, and showing the insertion of a data-carrying member in its normal position and in its rotated position in phantom.

Turning to the embodiment shown in FIGS. 14–16, there is shown a combined bracket and support member 100 which is somewhat similar in construction to that shown in FIGS. 5 and 6. The distinction is that it has a series of frangible slats 102 on the base that may be removed as desired (see FIGS. 15) to allow it to be accommodated within ticket rails of different opposed channel widths. The unit may be made of hardened, plate spring steel or extruded plastic to allow frangibility. It is slightly different in appearance in that it has an extended lower leg 104 carrying the frangible slats 102. The upper leg 106 is much shorter and both are depending parallel and aligned arm portions 108, 110 terminating in the circular hook portion 112 engaging a data-carrying member having slots.

It is to be recognized that numerous modifications, changes and adaptations to the present invention are possible, and therefore the true scope of the invention is to be measured by the annexed claims.

What is claimed is:

1. In combination with a shelf for displaying and dispensing products in a store environment, said shelf having a longitudinally extending front face;

bracket means;

attaching means securing said bracket means to said shelf front face; and an information carrying card mount including a rectangular plate section having front and rear faces and means for releasably engaging information bearing tickets onto said plate section front and rear faces to replacably retain said information bearing tickets in positions overlying said front and rear faces, said mount being coupled to said bracket and freely swingable about a longitudinal axis between opposite upwardly projecting and depending positions to provide selective alternative visual access to said tickets overlying said plate front and rear faces.

2. The combination of claim 1 wherein said bracket means and mount are formed of plastic as an integral unit and swingably connected by a shelf-hinge.

3. The apparatus of claim 1 wherein said attaching means includes a shelf edge ticket rail.

4. A data information display device for use in conjunction with products displayed in a store environment on a shelf provided with a shelf edge ticket rail including top and bottom inwardly directed lips, said device comprising:

bracket means adapted to mount on said rail and including a plate-like member having at least two pairs of parallel sides, each of said side pairs defining a different distance therebetween;

a support member including a post, said plate-like member being pivotably mounted on said post such that the plate-like member may be oriented such that a side pair separated by the distance defined by the width of the ticket rail will be retained within said rail top and bottom lips; and a data-carrying member in the form of a generally rectangular placard having front and rear surfaces and pivotably attached to said support member such that said front surface of said data-carrying member is normally visible and may be pivoted such that said rear surface may be seen, said data-carrying member then returning to its normal front surface-visible position.

5. In combination with a shelf for displaying and dispensing products in a store environment, said shelf having a longitudinally extending front face;

bracket means;

attaching means securing said bracket means to said shelf front face; and an information carrying card mount including a rectanglar plate section having front and rear faces and forwardly and rearwardly projecting inwardly facing channels extending longitudinally along the top and bottom edges of said plate section and adapted to replacably retain information bearing tickets in positions overlying said front and rear faces, said mount being coupled to said bracket and freely swingable about a longitudinal axis between opposite upwardly projecting and depending positions to provide selective alternative visual access to said tickets overlying said plate front and rear faces.

6. The combination of claim 5 wherein said shelf includes a ticket rail extending along said shelf front face and having inwardly directed longitudinal lips and said attaching means includes a coupling member engaging said ticket rail and retained by said lips.

7. The combination of claim 5 wherein said attaching means includes an adhesive layer between a face of said bracket means and said shelf front face.

8. The combination of claim 5 wherein said bracket means and mount are formed of plastic as an integral unit and swingably connected by a self-hinge.

9. The combination of claim 5 wherein said mount is biased to its depending position.

* * * * *